US012662784B2

(12) United States Patent
Geer

(10) Patent No.: US 12,662,784 B2
(45) Date of Patent: Jun. 23, 2026

(54) ICE EDGER BRUSH APPARATUS

(71) Applicant: Koleson Geer, Gillette, WY (US)

(72) Inventor: Koleson Geer, Gillette, WY (US)

( * ) Notice: Subject to any disclaimer, the term of this patent is extended or adjusted under 35 U.S.C. 154(b) by 368 days.

(21) Appl. No.: 18/452,746

(22) Filed: Aug. 21, 2023

(65) Prior Publication Data

US 2025/0067011 A1 Feb. 27, 2025

Related U.S. Application Data

(60) Provisional application No. 63/421,872, filed on Nov. 2, 2022.

(51) Int. Cl.
*E01H 4/02* (2006.01)

(52) U.S. Cl.
CPC ..... *E01H 4/023* (2013.01)

(58) Field of Classification Search
CPC .. E01H 4/023; E01H 5/12; E01H 4/02; E01H 5/066; E01H 2004/026; B28D 1/188; A01D 42/08; E04G 23/006; E04F 21/22
See application file for complete search history.

(56) References Cited

U.S. PATENT DOCUMENTS 2,642,679 A 6/1953 Zamboni
2,763,939 A 9/1956 Zamboni
3,044,193 A 7/1962 Zamboni
3,178,837 A 4/1965 Capalbo
3,302,975 A 2/1967 Vandenberg
3,475,056 A 10/1969 Jones
3,504,434 A * 4/1970 Thomsen ..... E01H 4/023 30/477
3,591,236 A * 7/1971 Jones ..... E01H 4/023 299/24
3,622,205 A 11/1971 Zamboni
3,705,746 A 12/1972 McLeod
4,073,076 A * 2/1978 Fortune ..... E01H 5/066 293/49

(Continued)

OTHER PUBLICATIONS

Zamboni Euro Edger, "Edge with the Push of a Button", 2019, <https://zamboni.com/wp-content/uploads/brochures/EuroEdger_Brochure_web.pdf> (Year: 2019).*

*Primary Examiner* — Christopher J Sebesta
*Assistant Examiner* — Blake E Scoville
(74) *Attorney, Agent, or Firm* — WILLIAMS INTELLECTUAL PROPERTY

(57) ABSTRACT

An ice edger brush apparatus is capable of attachment to a lever arm assembly of a common ice resurfacing vehicle for use in edging the entirety of an ice rink surface, particularly the perimeter areas closest to the rink's boards, immediately prior to resurfacing the ice rink either before, during, or after an event, game, or occasion. The present invention allows for significantly faster and more complete edging, sweeping, and resurfacing of an ice surface, specifically a rink, as well as proper ice level and board protection through the novel combination of blades, brushes, protective guards, support members, and other components identifiable within the ice edger brush apparatus, all of which may be fitted to an existing extendable lever arm of an ordinary resurfacing vehicle such that an operator may retain control of the overall attributes of the present invention both prior to and throughout operational use.

12 Claims, 6 Drawing Sheets

(56) References Cited

U.S. PATENT DOCUMENTS

| | | | | | |
|---|---|---|---|---|---|
| 4,186,967 | A * | 2/1980 | Kuhmonen | E01H 5/12 | 37/243 |
| 4,295,274 | A * | 10/1981 | Bricher | B28D 1/188 | 15/93.1 |
| 4,372,617 | A * | 2/1983 | Zamboni | E01H 4/023 | 299/24 |
| 4,705,320 | A | 11/1987 | Zamboni | | |
| 4,918,844 | A * | 4/1990 | Marsh | E01H 4/023 | 37/227 |
| 7,124,521 | B1 * | 10/2006 | Medoro | E01H 4/023 | 37/285 |
| 7,364,240 | B2 * | 4/2008 | Seely | E01H 4/023 | 37/219 |
| 7,380,355 | B2 | 6/2008 | Donaldson | | |
| 7,698,837 | B2 | 4/2010 | Seely | | |
| 7,757,415 | B2 | 7/2010 | Manion | | |
| 7,765,724 | B2 | 8/2010 | Walker | | |
| 2007/0277404 | A1 * | 12/2007 | Lun | E01H 5/04 | 37/243 |
| 2019/0376246 | A1 * | 12/2019 | Vachon | E01H 5/067 | |

* cited by examiner

ICE EDGER BRUSH APPARATUS

BACKGROUND OF THE INVENTION

While a variety of ice edgers and brushes are known in the prior art, these devices and apparatuses are typically seen as components, or elements, of a larger ice-resurfacing vehicle that may be self-propelled or a smaller ice edging machine that is typically push-propelled. The most well known ice resurfacing machine, in the eyes of the public and especially fans of the National Hockey League, is the Zamboni named after the inventor thereof. Although ice resurfacing vehicles and ice edging machines in the field of endeavor are generally quite similar to one another, respectively, various differences exist within the prior art that allow for differentiation between patented inventions.

For instance, U.S. Pat. No. 3,622,205 by Zamboni includes an ice-resurfacing unit, comprised of a single blade, disposed transversely across the rear of a larger vehicle, and connected via a towing linkage, having runners at its ends that sit upon the ice. The runners cap each end of the single sharp-edged blade, which lightly shaves the surface of the ice and uplifts any shavings present, to keep the blade positioned parallel to the ice surface at a specific distance therefrom thereby correcting any tendency of the blade to chatter, slip, or otherwise make uneven cuts. When not in use, the entire unit can be raised (or lowered for use) via hydraulic lift cylinders and two laterally spaced lift arms attached to both the vehicle's frame and the unit's pivot points, such that flexible joint members allow for the vertical swinging movement. In order to exert equal downward pressure upon the unit, and the blade thereof, spring bearing pressure is utilized with torque exerting the downward force while some of the vehicle's weight may also be transferred to the unit holding the blade against the ice. This combination of pressure sources helps keep the blade pressed firmly and equivalently across the ice while mitigating any changes in pressure that might be otherwise caused by the vehicle's motion, movement, turning, bouncing, or jostling. As the blade carves into the ice, the work screw conveyor collects the shavings, which are then transferred, into a tank, or bin, within the vehicle.

Similarly, U.S. Pat. No. 3,591,236 issued to Jones describes a self-propelled ice-resurfacing vehicle that includes an ice-removing unit mounted transversely to the rear of the vehicle. As with Zamboni's device, the singular cutting blade may be angled downward and shave the ice, as the brush sweeps the ice shavings into a conveyor, which in turn delivers the shavings to an elevator that conveys them to a tank mounted on the vehicle. While this device relies predominantly upon a hydraulic drive system (as well, in part, on the weight of the vehicle) to enable a gradual application of torque to thereby retain frictional engagement between the wheels and the ice, an equivalent method of applying hydraulic pressure to the blade component is utilized. Regardless of the method used to apply pressure, the single bladed component is mounted transversely on the bottom of the sled and measures approximately the width of the vehicle itself. Like in Zamboni, the bladed component is attached to the vehicle by pivotal connecting arms and a hydraulic drive unit that is used to raise and lower the element, as well as alter the blade height and angle of attack, both of which vary the depth of the cut being made.

Different than the previous patented apparatuses is U.S. Pat. No. 3,504,434 issued to Thomsen, which conveys an ice edger and line cutter intended to be pushed by a person, wearing skates or shoes, while removing the build-up of ice within an area of ten inches from the faces of the boards and leveling any high, or uneven, spots present on the ice surface. Like the previous ice resurfacing machine, this ice edger has adjustable blade control for angled positioning of the blade and depth of cuts being made thereby, but such control may be utilized prior to beginning the edging process. However, unlike the aforementioned devices, this ice edger relies upon various support arms, feet, and other components to control the position of the rotary cutting assembly, which includes a circular mounting disk having downwardly facing open grooves into which carbide tipped cutting members are secured prior to the start of edging.

Unlike ice resurfacing vehicles, which are well known to accomplish the task of quickly clearing the majority of the ice surface and laying down a fresh film of water to freeze into a unblemished layer of ice, push or pull ice edgers and cutters take far longer to finish their task as the majority of such devices require individual persons to operate by pushing/pulling them across the entire ice surface. The task of re-edging an ice surface can take up to several hours of work depending on how bad the ice surface is, including how many gouges and indents are present as well as how deep they are, and based on the quality of the machine, it's blades, and its power source. These devices are also differentiated from ice resurfacing machines in that they may approach the boards along an ice rink and remove built up ice while leveling out the perimeter of the ice surface, although potentially causing damage to the boards, while larger ice resurfacing machines can not get nearly as close to the boards for fear of causing damage (to the vehicle, components thereof, as well as the boards) and therefore can't efficiently nor effectively resurface the ice rink's edges, where most of the ice accumulation occurs and which is therefore the least level portion of the rink.

Other patented means of resurfacing and edging ice surfaces include, U.S. Pat. No. 7,380,355 issued to Donaldson, U.S. Pat. No. 7,698,837 issued to Seely, and U.S. Pat. No. 4,372,617 issued to Zamboni. The '355 patent describes a manually propelled ice rink resurfacing device mainly comprising a mounted water tank, a wheelable chassis, and a heat chamber, wherein ice shavings and snow are collected by the apparatus and melted to then be reapplied as a fresh layer of water upon the ice rink. Similarly, the '837 patent covers an ice resurfacing machine attachable to a light towing vehicle that is capable of eliminating ruts, gouges, and cuts in ice by scraping a thin layer of ice off the surface via a single transverse blade element and filling the hole with this "snow" then adding water. Lastly, designed as an attachment for larger ice resurfacing vehicles discussed above, the '617 patent covers an edging apparatus comprising an attachment to one side of the resurfacing machine capable of contacting upright surfaces (such as boards) wherein a single ice shaving blade connected to a ski-like element may extend to contact and shave the ice adjacent to the walls of an ice rink prior to retracting into the vehicle, or underneath one of its sides.

While additional prior art documents and devices exist within this field, the majority of the apparatuses and components thereof disclosed vary minimally from the prior art discussed above. There are multiple devices that are powered electrically, via combustible engines, hydraulics, or some combination of these methods. The overwhelming majority of the self-propelled apparatuses utilize single bladed components spanning the distance of the vehicle, machine, or device and are accompanied by conveyors (usually of a screw design), storage tanks or bins for ice shavings, and water spray nozzles with squeegees or polymeric spreaders for laying down new uniform layers of water that will become the fresh ice layers. Other apparatuses, mainly push/pull edgers and manual resurfacers, rely on additional workers and devices that operate to level the ice, remove the ice shavings, and then lay down a fresh ice layer, however, these tasks take multiple hours to complete and therefore are typically accomplished only once a day, especially not during an event, game, or other occasion.

What is needed in the art is an ice edger brush apparatus that may be attached to a typical self-propelling ice resurfacing vehicle, which combines the two processes of edging and sweeping into a single device that may edge an entire ice surface, with a capacity to then resurface the rink immediately given its attachment to such a device, in the same time is takes to normally resurface the ice rink (or at least in substantially less time than it would take to edge the ice rink manually). Additionally, this device would need to have the capability of edging the ice surface at a position close to, if not directly along, the boards without causing damage to either the device (or vehicle) itself or to the boards, with a means of board protection incorporated therein. To have commercial utility, this device should be installable as a component of a larger ice resurfacing vehicle (ideally hydraulic-based), and designed to be compatible therewith. In lieu of the traditional and typical single-bladed system installed permanently at the vehicle's rear underneath the operator's seat, this device would need to extend from (and retract into) the vehicle's underside and incorporate blades and brushes to simultaneously edge the ice rink's perimeter while removing the produced ice shavings, thereby giving the operator a clear line of sight. This device must also include some means of controlling the bladed element's angle of attack (relative to both the ice surface and the boards), height, distance from the boards, and depth of cut throughout its use.

FIELD OF THE INVENTION

The present invention relates to an ice edger brush apparatus, and more particularly, to an ice edger brush apparatus that relates to an attachment for an ice resurfacing machine, and with controlled extension therefrom, which is capable of edging at a position immediately adjacent to the boards of an ice rink, while simultaneously brushing away shavings and snow, then laying down a fresh surface of ice via the resurfacing vehicle's capability as seen in the prior art, and accomplishing the edging process in a substantially shorter period of time than any prior devices.

SUMMARY OF THE INVENTION

The general purpose of the ice edger brush apparatus, described subsequently in greater detail, is to provide an ice edger brush apparatus which has many novel features that result in an ice edger brush apparatus which is not anticipated, rendered obvious, suggested, or even implied by prior art, either alone or in combination thereof. What follows is a brief summary of the present invention as depicted in exemplary embodiment drawings, however, it should be understood that while the components, features, elements, and capabilities of the example embodiment of this invention are summarized and described in detail below, additional embodiments that capture the essence of the device are contemplated and considered within the scope of the ice edger brush apparatus.

The present invention is directed to an ice edger brush apparatus capable of operating alone as a manual (push/pull) device or as an attachment for an ice resurfacing vehicle, comprising a mounting support and leading framework assemblies for attaching the device to an extendible lever arm under the side of said vehicle, as known in the prior art, wherein the ice edger brush apparatus may extend outward from underneath the vehicle and downward (with a flat or angled orientation) toward the ice surface for use with all edging, brush sweeping, and related tasks, prior to being raised and retracted back into the vehicle's undercarriage. This capability of extension and retraction may be due to either a vehicular pivot frame or at least one extending arm (with separate stabilizing arm) having a pivot joint along its length with a portion thereof connected to the vehicle's frame and another portion having a motor, or rotating mechanism, attached to the upper components of the ice edger brush apparatus, both of which are known devices in the art. The various elements of both the ice edger brush apparatus and the extending arm assembly connected thereto allow for an operator to enjoy full control over the entire range of motion for the apparatus, including the extending/retracting, raising/lowering, altering of the blades' attack potential, as well as rotational speed and maneuverability. This is in addition to the operator setting and adjusting the requisite fasteners relating to skid plate and blade angles prior to use, however, the automation of this setting is contemplated as within the scope of this invention.

The ice edger brush apparatus includes a hub member that may serve as the central connection point for a plurality of brush members and blade members attached thereto, as well as a gimbal mechanism that may be contained within the core of the hub member whose upper base component may attach to the aforementioned extending arm via a (drive shaft) motor or rotating mechanism. Positioned between the extending arm and the ice edger brush apparatus's blades and brushes may sit a brush guard assembly, which is designed to protect both the device itself as well as the ice surface and rink boards, with at least one component thereof being attached to the aforementioned stabilizing arm. Within the assembly, the brush guard may be positioned atop the support member and may include a wheel element designed to remain in contact with the boards to guarantee no blade member coming into contact therewith, although the brush members may extend beyond the wheel's locations to allow for clearing and/or cleaning of the boards during use. The support member is designed to connect to the aforementioned stabilizing arm, also attached adjacent to the proximal end of the extending arm component connected to the ice resurfacing vehicle, in addition to the possible inclusion of a skid plate element fastenable to the member and downwardly protruding therefrom to remain in constant contact with the ice surface as a position outside of the reach of any brush member, thereby offering both additional protection as well as another control on the height and angle of attack of blade members.

Additionally included components may include at least one grease port, additional blade or brush members, alternatively designed blade or brush members, as well as alternative shapes of the aforementioned elements and means of attaching, fastening, or otherwise coupling of the aforementioned elements. Likewise, additionally contemplated embodiments of the invention may see alternative shapes, forms, and designs of the aforementioned elements and structural features.

Unlike those devices and apparatuses discussed previously, the present invention ice edger brush apparatus allows for simultaneous edging via at least one rotating blade member wherein a plurality are contemplated and illustrated in the example embodiments, brushing (or sweeping) via at least one rotating brush member wherein a plurality are contemplated and illustrated in the example embodiments, followed by resurfacing operating in concert with one another, as opposed to a singular stationary long blade followed by some means of removing the ice shavings created thereby, usually via a screw conveyor. Also, unlike the previous machines, the capability of side extensions/retraction will allow for complete cleaning, edging, and resurfacing of an ice rink, thereby offering a solution to the current problem of operating near the boards and/or causing damage to the rink's surface or perimeter. And, lastly, the capability of one device to clean, edge, and resurface in substantially less time than the current individual machines, devices, and apparatuses necessary to prepare an ice rink illustrate the utility and novelty of the ice edger brush apparatus.

Thus has been broadly outlined the more important features of the present ice edger brush apparatus so that the detailed description thereof that follows may be better understood and in order that the present contribution to the art may be better appreciated.

Objects of the present ice edger brush apparatus, along with various novel features that characterize the invention are particularly pointed out in the claims forming a part of this disclosure. For better understanding of the ice edger brush apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
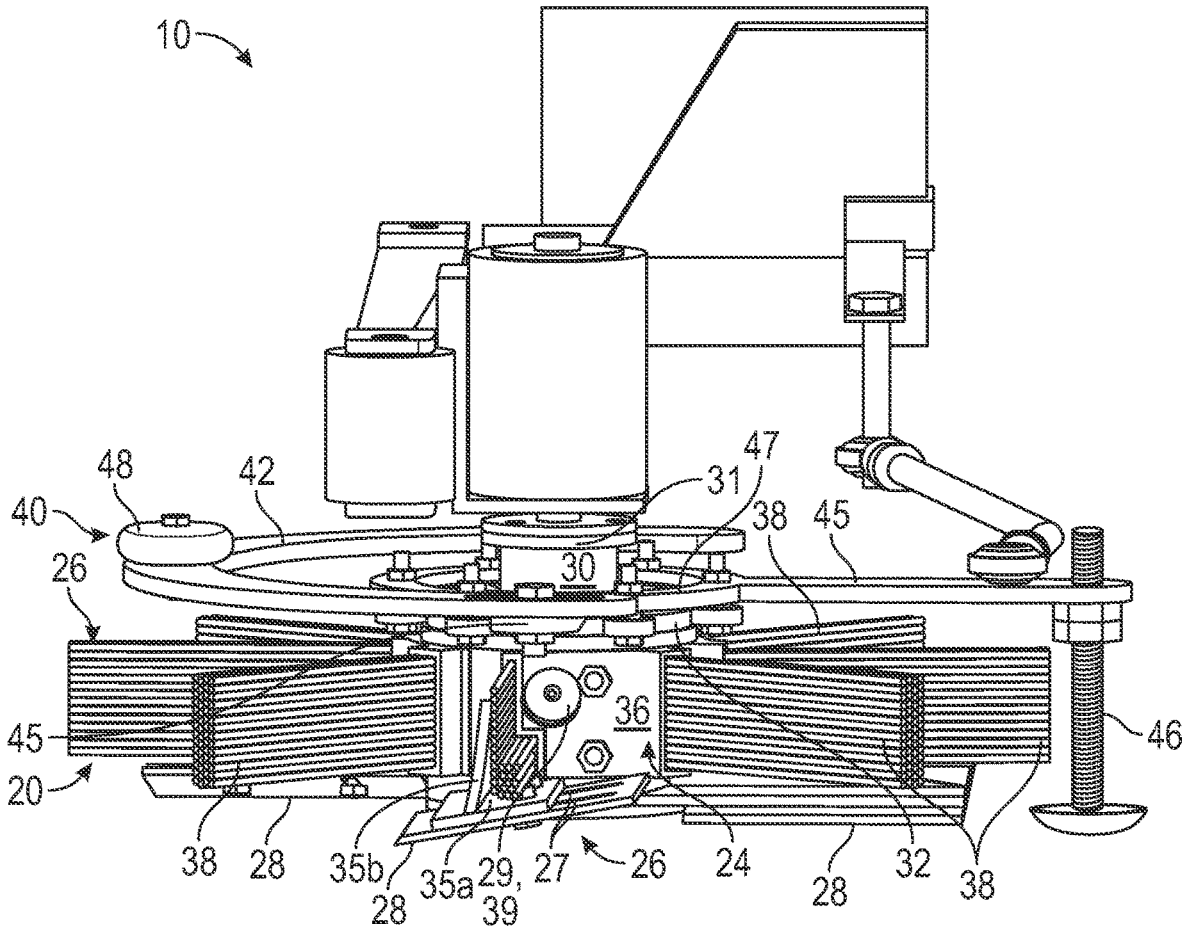
FIG. 1 is a side view of an example embodiment of the ice edger brush apparatus attached to a lever, or extending, arm assembly known in the prior art.
Figure 2:
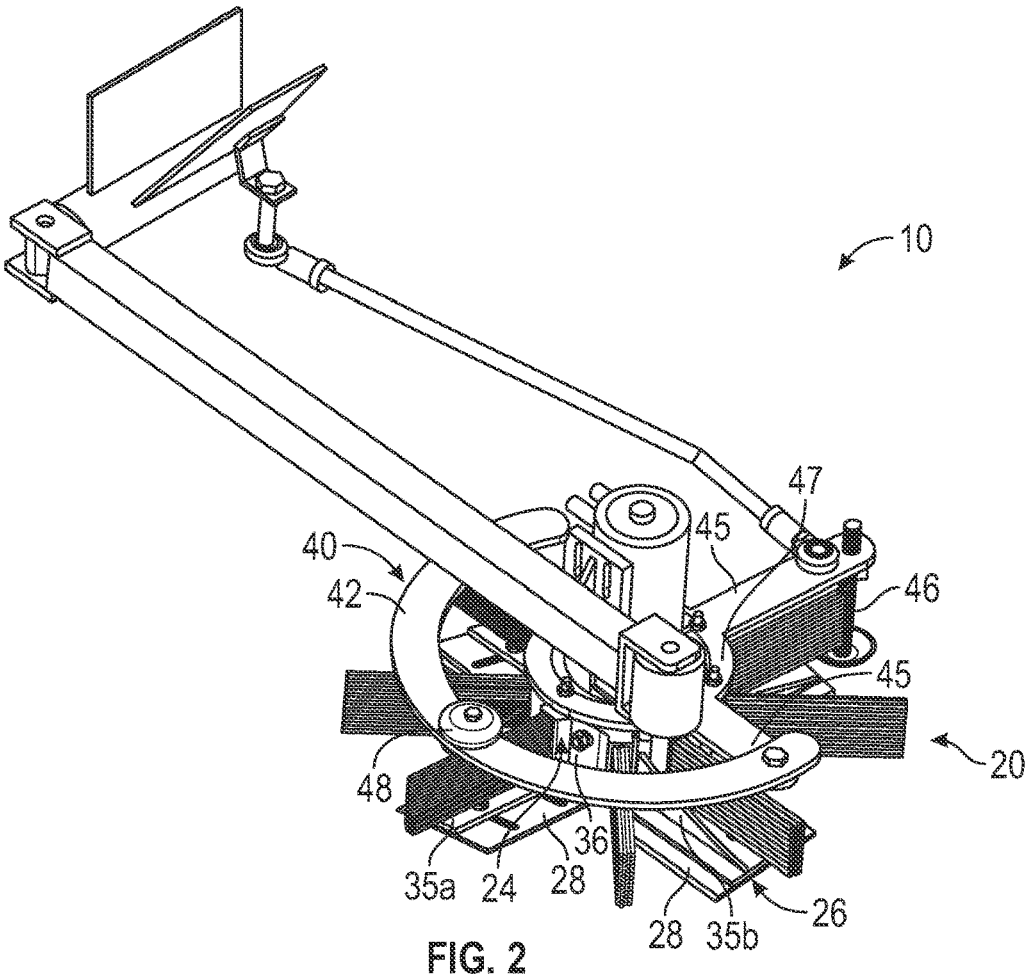
FIG. 2 is an elevated diagonal view of the same example embodiment.
Figure 3:
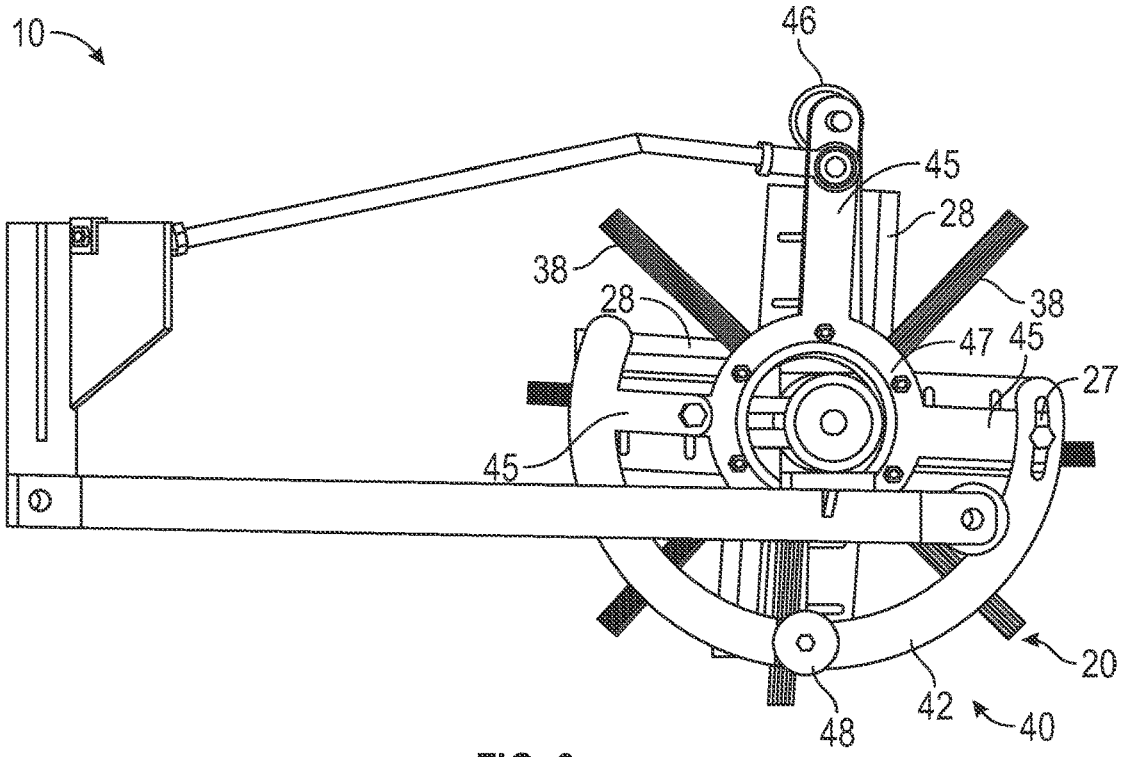
FIG. 3 is an aerial view of the same example embodiment.

With reference now to the drawings, and in particular FIGS. 1 through 10 thereof, example of the instant ice edger brush apparatus employing the principles and concepts of the present invention and generally designated by the reference number 10 will be described.

Referring to FIGS. 1 through 4, in which a preferred embodiment of ice edger brush apparatus 10 is illustrated. Ice edger brush apparatus 10 is depicted in these FIGS. as including brush blade assembly 20 attached to brush guard assembly 40, both of which are attached to a lever arm assembly that is known and understood in the art and utilized by ice resurfacing vehicles therein. Brush blade assembly 20 is shown, in this example embodiment, to possess a rotatable cylindrical hub member 22 (shown in FIGS. 5, 6, 8, and 9 but obscured from view in FIGS. 1 through 4 due to engagement with surrounding components, as will be explained below) surrounded by a plurality of brush members 24, radially disposed circumferentially thereabout, a plurality of blade members 26, similarly radially disposed circumferentially around the former and below the latter, and at least one hub grease port aperture 29. Each of said plurality of brush members 24 is depicted in the drawings as possessing at least one mounting member 36 having at least one elongate brush body 38 fixed thereto, wherein at least one mounting member 36 possess a brush grease port aperture 39 that aligns with hub grease port aperture 29. In this example embodiment, and in consideration of the cylindrical nature of hub member 22, mounting members 36 possess an arced interior wall that contacts each point of the exterior surface of hub member 22 and aligns with any, and all, peg protrusions 37 jutting therefrom regardless of their shape and dimensions. Each of said plurality of blade members 26 is similarly depicted in the illustrations as including at least one blade plate member 28 having a honed leading edge at its front end and a flat rear end, wherein at least one elongated aperture 27 oriented therebetween allows for operational coupling to hub member 22, or a structural element attached thereto, and a maneuverable angular orientation.

Although not illustrated, additional embodiments are contemplated wherein hub member 22 is of a non-cylindrical form, such as square, triangular, rectangular, or other polygonal shapes, while the plurality of mounting members 36 are complementarily designed to abut the alternatively shaped hub member 22. Similarly, though not illustrated herein, the plurality of blade members 26 may include alternatively shaped blade plate members 28 that are round, curved, triangular, rectangular, shaped to resemble other polygons, or such that a single blade plate member 28 shaped as a cross, circle, or other shape may be utilized, wherein the aforementioned elongated aperture 27 or some other expanded aperture that may accomplish the same function will be present and operationally engage with hub member 22 as set out herein. Likewise, each elongated brush body 38 is depicted herein as rectangular and possessing bristles of uniform dimensions stacked in parallel; however, the present invention is contemplated as including other shapes and designs of elongated brush body 38, such as those shapes aforementioned in relation to blade member shapes, as well as bodies possessing non-uniform bristles, splayed designs, and bristles of different polymeric and non-polymeric materials that are equally capable of clearing the ice and boards of shavings as depicted in the example embodiment. In short, the shape, dimensions, material, and numerosity of the aforementioned structural elements hub member 22, peg protrusions 37, mounting members 36, blade members 26, blade plate members 28, and elongated brush bodies 38 are contemplated within the present invention as differing from those illustrated in the figures herein, but should not be considered as limited exclusively to those additional embodiments detailed above.

Further, in the example embodiment of FIGS. 1 through 4, hub member 22 is depicted as possessing gimbaled drive shaft 30 that protrudes from its position within the core of hub member 22 to a point above brush guard assembly 40, a flange 32 having a track along its underside may be seen near the first end of hub member 22, and a plurality of strut members 34 may be seen radially disposed circumferentially about second end hub member 22. Additionally, as each brush member 24 is illustrated as possessing a mounting member 36 having at least one elongate brush body 38, in this example embodiment said elongate brush body 38 is comprised of a plurality of bristles of equal proportions connected in parallel, wherein at least a single mounting member 36 includes a brush grease port aperture 39 that aligns with hub grease port aperture 29 of hub member 22.

In the example embodiment depicted within FIGS. 1 through 4, each mounting member 36 possesses two elongate brush bodies 38, with a single elongate brush body 38 nearest hub grease port aperture 39 missing about half of its bristles to allow for proper excretion of grease through both hub and brush grease port apertures 29, 39 into the assembly. Mounting members 36, depicted as having arced inner walls, are fastened circumferentially to the exterior wall of hub member 22 while blade plate members 28 are fastened to strut members 34, which are themselves affixed to the exterior of hub member 22. Each of the plurality of strut members 34 is depicted as possessing a relatively horizontal portion 35*a*, which possesses at least one aperture therethrough for the operation coupling of at least one blade plate member 28, as well as a relatively vertical portion 35*b* affixed to both the relatively horizontal portion 35*a* and the exterior of hub member 22. These relatively horizontal and vertical portions 35*a*, 35*b* may be affixed at true orthogonal dimensions, or at slightly angled positions relative to one another and/or hub member 22, while additional embodiments may contemplate these portions as attached in a manner to allow for increased maneuverability and altering of the angles of affixation. As mentioned above, in additional contemplated embodiments, the bristle elements of elongated brush bodies 38 may be of unequal proportions, dimensions, lengths, widths, or of different material similarly capable of sweeping the shavings and along the boards as those depicted in the illustrated example embodiment, while horizontal and vertical portions 35*a*, 35*b* of strut members 34 may be of different shapes, angular orientations (relative both to one another and to hub member 22), or include additional apertures.

Although only a portion of gimbaled drive shaft 30 is visible in the example embodiment depicted by FIGS. 1 through 4, it includes a lower base portion 33 that is operationally securable to the second end of hub member 22 and an upper base portion 31 that is depicted as extending through the core of brush guard assembly 40 and being operationally couplable to the motor, or rotational mechanism, of the lever arm assembly known in the art and commonly utilized by ice resurfacing machines.

Brush guard assembly 40, disposed about the first end of hub member 22, is depicted as possessing leading portion 42 having wheel member 48, which guides ice edger brush apparatus 10 by rolling against the ice rink's wall to prevent contact with every component thereof except a distal endwise portion of each elongated brush body 38. As depicted in FIGS. 1 through 4, this wheel member 48 is secured to leading portion 42 via a fastener positioned through a central bore of wheel member 48 and the centrally positioned aperture of leading portion 42. However, wheel member 48 may embody alternatively contemplated shapes and designs that still allow it to function properly. Leading portion 42 is depicted in the example embodiments as semi-lunate in shape and form, but may embody alternatively contemplated shapes and designs in other embodiments. Additionally contemplated embodiments may see multiple wheel members 48 present along leading portion 42, as well as other means of guaranteeing that the components of ice edger brush apparatus 10 maintain a safe distance from ice rink walls.

Brush guard assembly 40 is also depicted as including support member 44, which possesses an aperture at the distal end of each offshoot member 45, wherein the longest such member depicts skid prevention member 46 as fastened to one such aperture with a second, relatively proximal, aperture which is operationally couplable to the stabilizing arm of the aforementioned lever arm assembly. As depicted in this example embodiment, leading portion 42 is fastenable to support member 44 via two apertures, wherein each aperture is located at each of the distal ends of two separate offshoot members 45 of support member 44, positioned 180 degrees from each other and extending outwardly. A fastener may be employed to secure the aperture of the first oppositely-positioned offshoot member 45 to an aperture of leading portion 42 located at the distal end of an inwardly protruding offshoot member 45 positioned about the first end thereof. Additionally, another fastener may be utilized to secure the aperture of the second oppositely positioned offshoot member 45 of support member 44 to elongated aperture 27 of leading portion 42.

The illustrated example embodiment of FIGS. 1 through 4 shows ring portion 47 of support member 44 as containing a plurality of equidistantly oriented apertures (not visible in figures due to presence of fastening members therein) wherein an equivalent plurality of rotatable bearing fastening members may be secured such that each head thereof is engaged with the track disposed underneath flange 32 of hub member 22. This positional alignment and operational communication of elements allows for the rotation of brush blade assembly 20 without the equivalent movement of either brush guard assembly 40 or the lever arm assembly, outside of the motor or rotational mechanism thereof. Within the illustrated example embodiment, the lever arm's motor is affixed to upper base portion 31 of gimbal drive shaft 30, with lower base portion 33 operationally coupled to hub member 22 such that when the rotation cycle begins, the entire brush blade assembly 20 spins. However, due to the utilization of the track under flange 32, and the rotatable bearing fastening members (or their equivalents in additionally contemplated example embodiments), brush guard assembly 40 does not rotate and thereby allows wheel member 48 and skid prevention member 46 to remain in stationary contact with the ice rink walls and ice rink surface, respectively. As stated above, wheel member 48 keeps all components of the ice edger brush apparatus (except a portion of elongated brush bodies 38) from contacting the ice rink walls and potentially causing damage thereto, while skid prevention member 46 is set at a specific height relative to the individually set blade plate members 28 to keep the cuts being made to the ice surface uniform.

Figure 4:
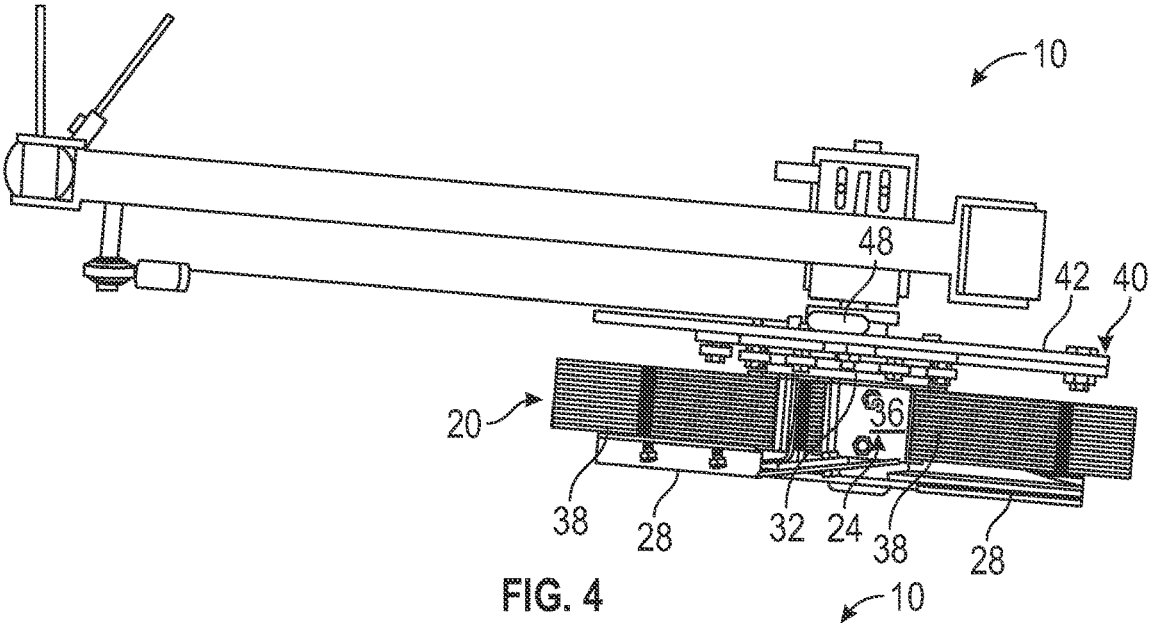
FIG. 4 is a front view of the same example embodiment.

Specifically referring to FIGS. 1 and 4, ice edger brush apparatus 10 is depicted in at least two of its possible extended positions, namely extended outward flat and at an angle. As is known in the prior art, extension arms that stow mechanical elements underneath ice resurfacing vehicles may be utilized with brushes or a blade. These arms are typically hydraulically operated by the driver, but may also utilize other means of extension and retraction. These illustrations depict the capability of the driver to alter the height, angle, and rate of rotation of ice edger brush apparatus 10, while the setting of the skid plate member 46 and wheel member 48 halt any potential danger of cutting into the ice too deeply or non-uniformly and of damaging the boards.

Figure 5:
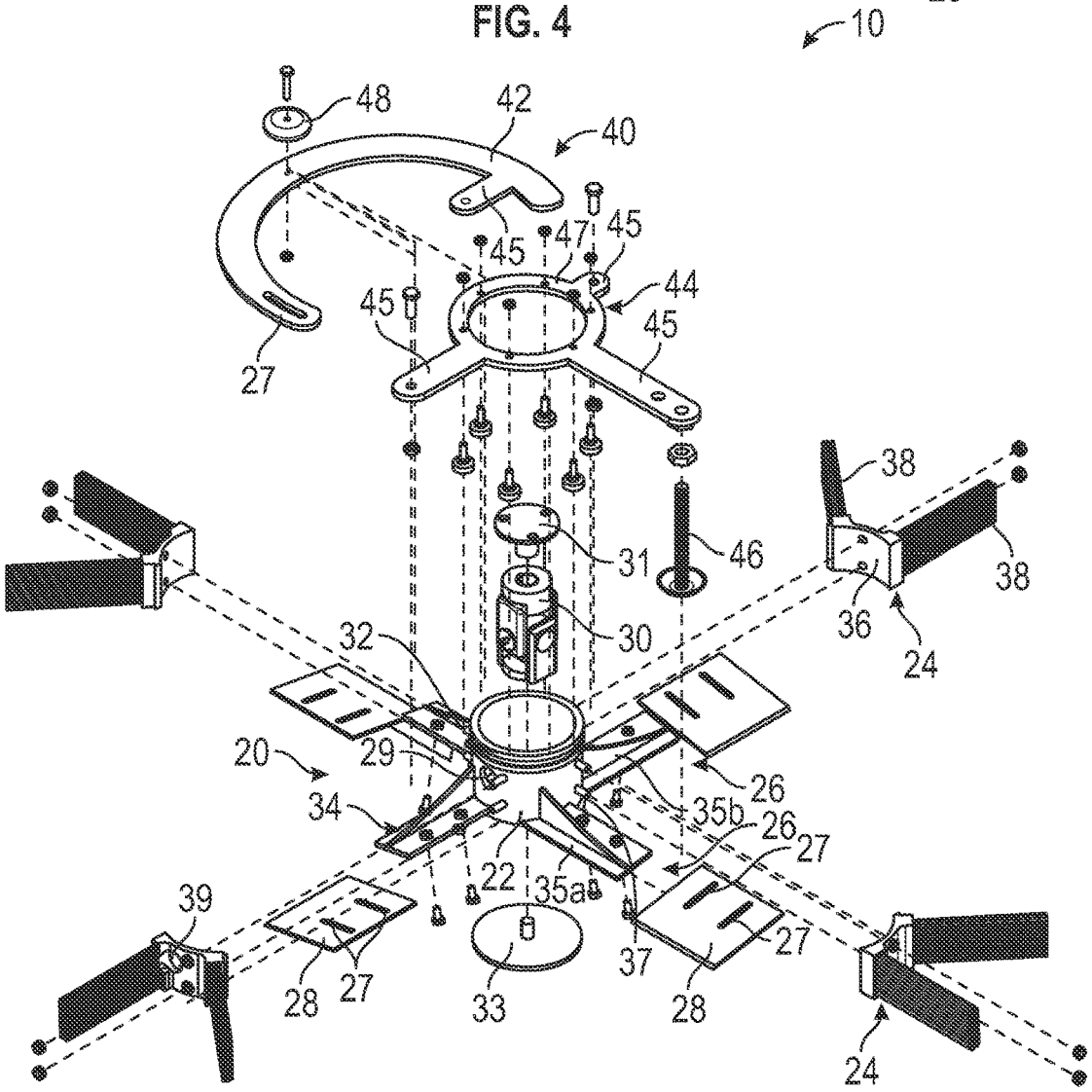
FIG. 5 is an exploded elevated diagonal view of an example embodiment of the ice edger brush apparatus without the lever arm assembly.

Referring next to FIG. 5, the components of brush blade assembly 20 and brush guard assembly 40 are depicted in an exploded-view image. Rotatable hub member 22, illustrated as a hollow cylindrical shape, is depicted as having four blade members 26 each having a strut member 34, wherein each said strut member 34 is comprised of a relatively horizontal portion 35*a* having two apertures therethrough and a relatively vertical portion 35*b*, such that both portions are affixed to hub member 22 and to one another. Additional contemplated embodiments involve the inclusion of additional, or fewer, blade members 26 as well as the apertures therethrough. Blade plate member 28 is depicted as rectangular and possessing a leading edge end, two flat side edges, and a flat rear end with two elongated apertures 27 positioned therebetween such that fasteners may be positioned through both sets of apertures, strut and blade, thereby resulting in maneuverable securement of blade plate member 28 to strut member 34. Although two apertures, both elongate and/or not, are included in each component mentioned, additionally contemplated embodiments may include only one or more than two such apertures, as well as alternatively oriented, located, or shaped apertures, and additional or other means of operationally coupling said components together, such as by hooks, magnets, clamps, hinges, locks, or the like.

As illustrated in FIGS. 5 through 10, rotatable hub member 22 possesses a single hub grease port aperture 29 and four pairs of peg protrusions 37 placed about the exterior wall such that each mounting member 36, possessing two apertures therethrough and a complimentary arced interior wall, may be operationally secured to hub member 22 via fastening elements. Each mounting member 36 is depicted as possessing two elongated rectangular brush bodies 38 positioned endwise along the member's length, wherein each body is comprised of a plurality of bristles oriented in parallel, and at least one mounting member 36 will always possess a brush grease port aperture 39 that will align with hub grease port aperture 29. Additionally contemplated embodiments may include additional peg protrusions 37, and/or protrusions of alternative shapes and sizes along the exterior wall of hub member 22 with a complementary amount of apertures through mounting members 36, as well as an embodiment having only a single protrusion and aperture. Within these additionally contemplated embodiments, peg protrusions 37 may be of a different shape, such as diamond, square, or hooked protrusions among other example embodiments, and May operationally couple to mounting members 36 in different ways, such as via hooks, clasps, splitters, pin locks, ball detents, or other fastening means. Additionally contemplated embodiments may see the inclusion of additional or fewer brush bodies 38 (and bristles thereof) encompassing a variety of shapes, orientations, and positions abutting mounting members 36, as well as the positioning of said brush bodies 38 at varying positions along mounting members 36. Regardless of the shape that hub member 22 may embody, be it cylindrical, polygonal, or prismatic, the adjoining interior walls of mounting members 36 will be complementary in design such that the two components may abut one another without gaps present.

Still referring to FIGS. 5 through 10, hub member 22 is illustrated as possessing gimbal drive shaft 30 within its core such that lower base portion 33 of gimbal drive shaft 30, which possess a dimensionality equivalent to that of the second end of hub member 22, is operationally securable to hub member 22 once affixed to the second end of gimbal drive shaft 30. Lower base portion 33 is illustrated as securing to gimbal drive shaft 30 by means of a protrusion and bore operational coupling; however, additionally contemplated embodiments may employ fasteners, magnets, ball detents, interlocking portions, or other equivalent means of securement. Similarly, upper base portion 31 of gimbal drive shaft 30 is depicted as securing via a protrusion and bore, with other aforementioned means of securement additionally contemplated. Upper base portion 31 (unlike lower base portion 33) is illustrated in this example embodiment as possessing three apertures along its perimeter such that the lever arm assembly, as known and see in the prior art, may fasten thereto such that the rotational energy from the motor mechanism can transfer into brush blade assembly 20 and so that any angular orienting of ice edger brush apparatus 10 translates to every component therein. This rotational energy does not transfer into brush guard assembly 40 since gimbal drive 30 and its upper base portion 31 pass through the ring portion 47 of support member 44 and leading portion 42, but are not connected to, nor able to interact with, either. While the angular orientation will translate to every component due to the interconnectivity and operational coupling present between each aforementioned component.

As depicted in FIGS. 5 through 10, flange 32 is disposed at the first end of hub member 22, underneath which a track is present, such that the heads of the plurality of rotatable bearing fasteners, illustrated as operationally couplable to ring portion 47 of support member 44, engage with said track along the underside of flange 32. While ice edger brush apparatus 10 is in use, wherein brush blade assembly 20 is rotating, hub member 22 and its flange 32 will spin while support member 44 and leading portion 42 will remain stationary as none of the rotational energy translates between the two assemblies, even though they are secured to one another as aforementioned.

Support member 44 is illustrated to include three offshoot members 45 having rounded distal ends, wherein the longest such member has two apertures, one at its distal end for the fastening of skid prevention member 46 and one more proximal compared thereto for fastening to the stabilizing arm of the lever arm assembly. This skid prevention member 46 is illustrated as fastened to support member 44 such that it may be loosened, resituated, and tightened by the operator prior to use guaranteeing that it is always in contact with the ice during the invention's operation in order to stop all blade plate members 28 from contacting the ice past a certain level which allows more control over the depth of cuts. Other offshoot members 45, with similarly rounded ends, are illustrated as jutting outward from opposite sides of ring portion 47, coplanar with though ninety degrees away from the first offshoot member 45, wherein both members each possess an aperture at its distal end that may allow for operational coupling with leading portion 42.

As depicted in FIGS. 5 through 10, leading portion 42 is semi-lunate in shape, having elongated aperture 27 at its first end, wheel member 48 fastened thereto at a aperture nearly central along the portion's length, and a third aperture at the distal end of offshoot member 45 protruding inwardly from a location near the second end. The first oppositely positioned offshoot member 45 of support member 44 may be fastened to elongated aperture 27 of leading portion 42, wherein the fastener is maneuverably securable thereto such that it may be loosened, resituated, and tightened. The second oppositely positioned offshoot member 45 of support member 44 may be fastened to the aperture located at the second end of leading portion 42. And wheel member 48 is fastened to leading portion 42, but not so tightly that it is estopped from rotating or spinning. As ice edger brush apparatus 10 is moved along the boards, wheel member remains in constant contact with the boards as it spins, while skid prevention member 46 keeps all blades from digging too deeply into the ice rink surface. This combination guarantees close edging along the perimeter of the ice rink as well as level edging and resurfacing along the entire surface area of the ice rink.

Referring to FIGS. 6 through 10, multiple perspectives of brush blade assembly secured to brush guard assembly 40 without the inclusion of the existing lever arm assembly are shown. Without the presence of said lever arm assembly, the individual components of the figures are more clearly seen as compared to FIGS. 1 through 4, for instance it is now possible to identify the location of hub member 22, the core of which is occupied by gimbaled drive shaft 30, relative to the components which surround it and operationally engage to it. A contemplated design of gimbaled drive shaft 30, having an upper portion capped by upper base portion 31, extending above the majority of the remaining components of ice edger brush apparatus 10, is shown wherein a mechanical joint is identifiable along its length, most notably so in FIG. 6. This upper base portion 31 possesses a plurality of apertures that allow it to operationally engage with the known lever arm assembly, which includes a motor, drive, or some other source of rotational energy. The mechanical joint of gimbaled drive shaft 30 enables the operator of the present invention to alter the angle of ice edger brush apparatus 10, either prior to or during operation, to specific degrees thereby adjusting the attack angle (or angle of attack) of all blade members 26 relative to the ice surface. Gimbaled drive shaft 30 likewise possesses a lower portion capped by lower base portion 33, which is operationally engaged with hub member 22 such that the aforementioned rotational energy may be transferred to ice edger brush apparatus 10 as a singular unit.

Figure 6:
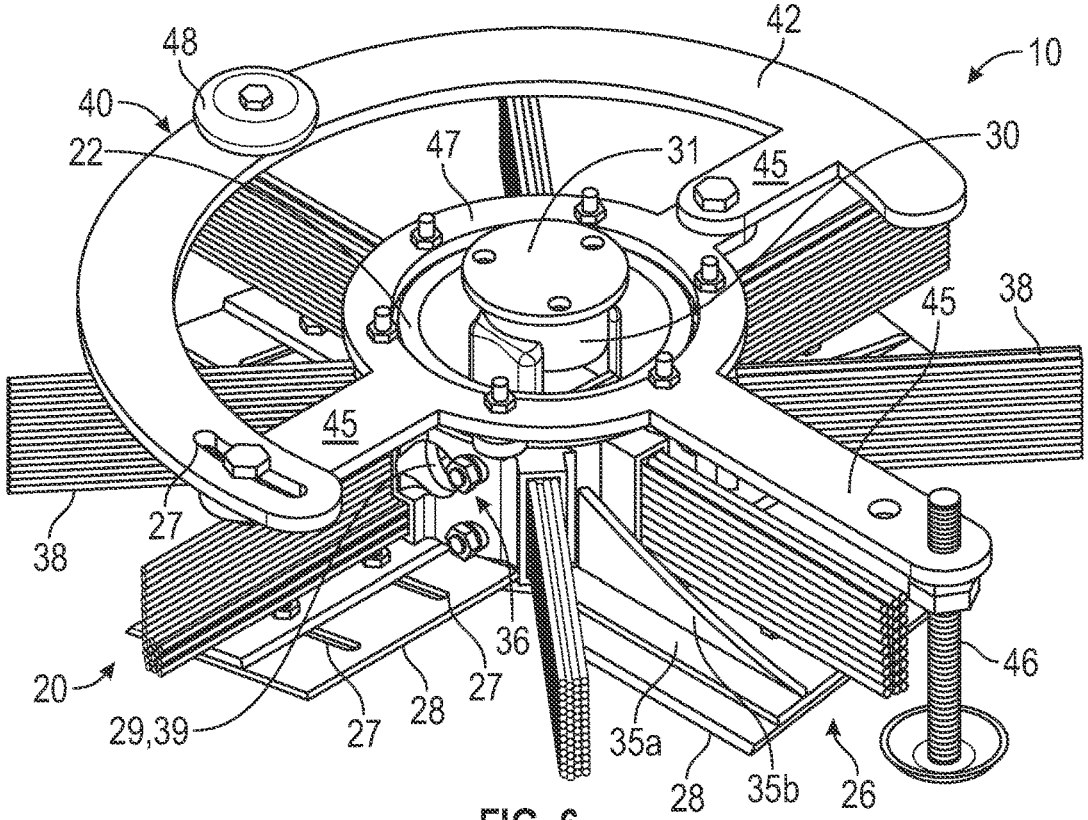
FIG. 6 is an elevated diagonal view of the ice edger brush apparatus without the lever arm assembly.
Figure 7:
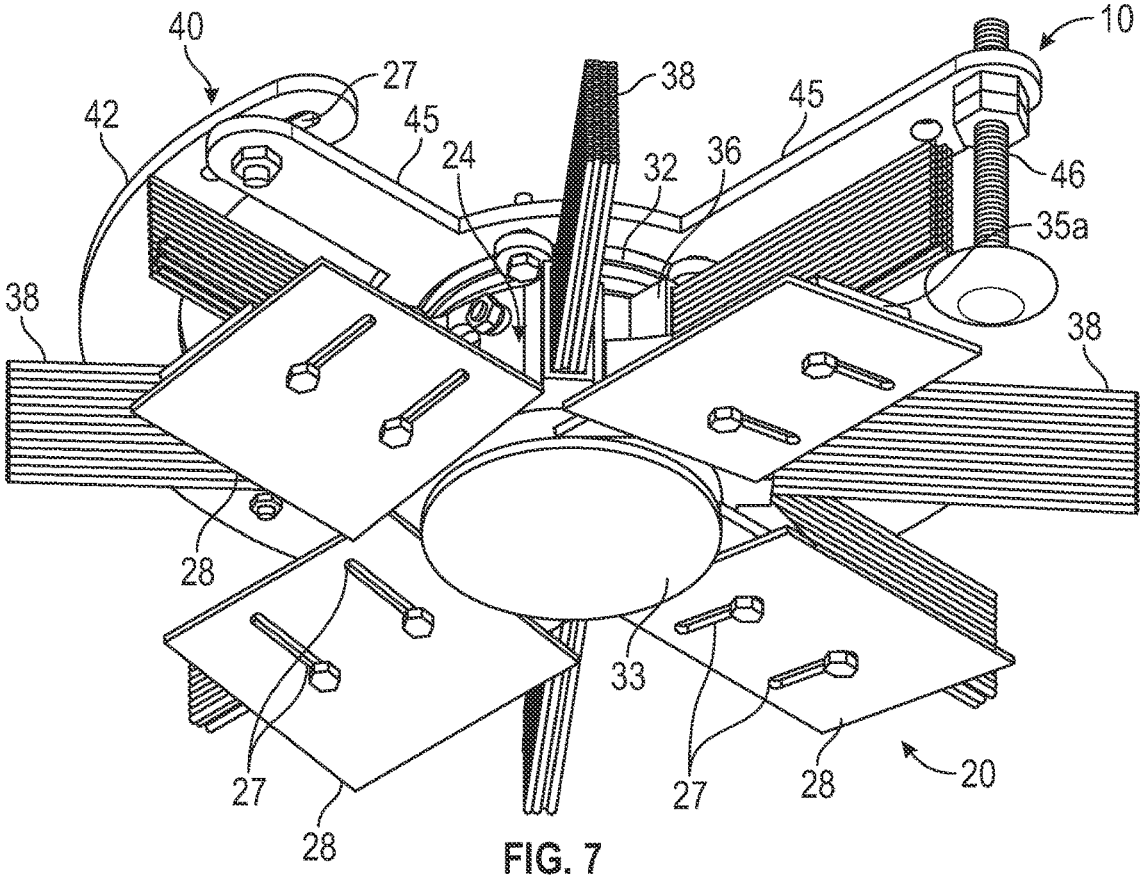
FIG. 7 is a depressed diagonal view of the same embodiment.
Figure 8:
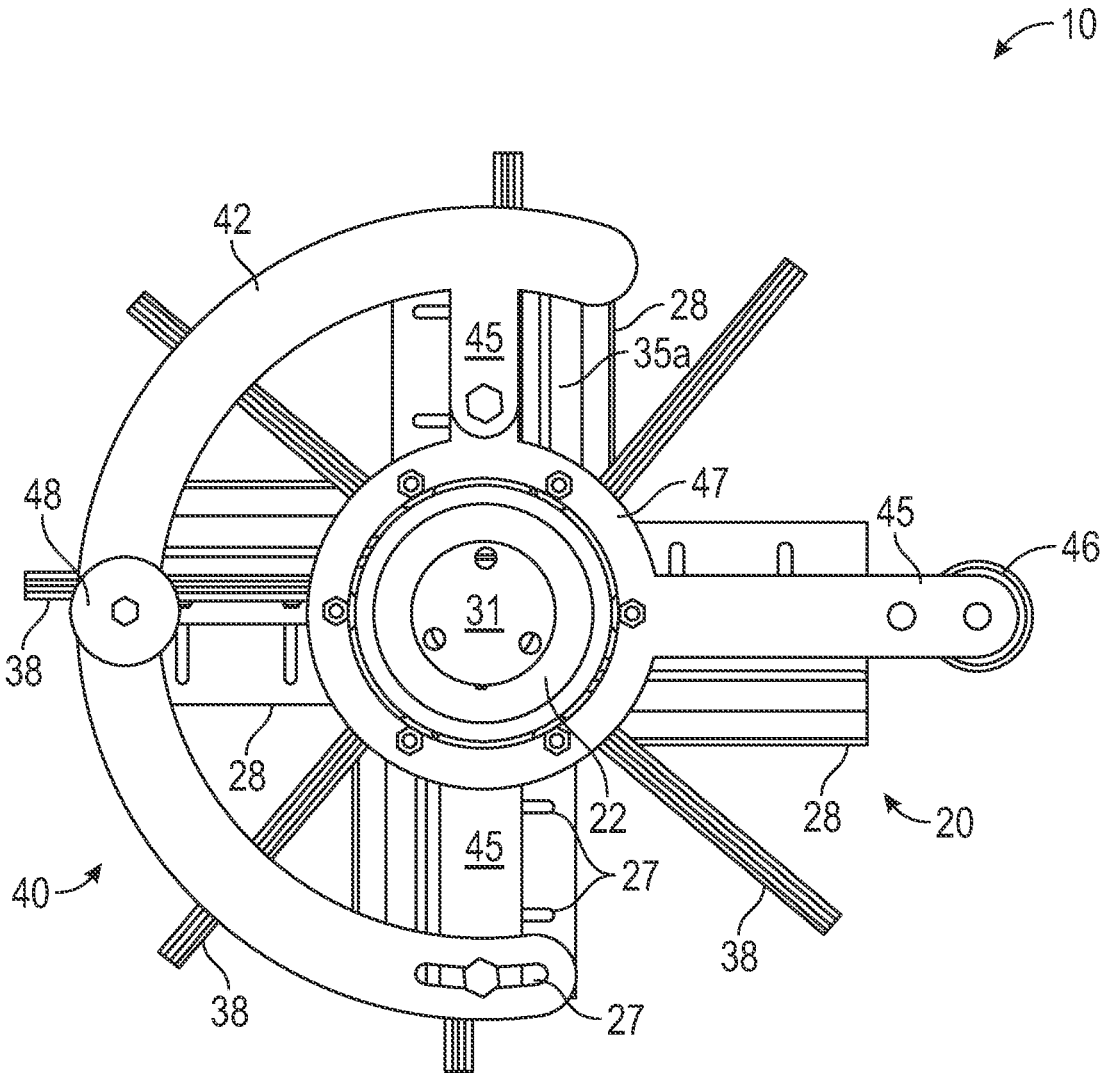
FIG. 8 is an aerial view of the same embodiment.
Figure 9:
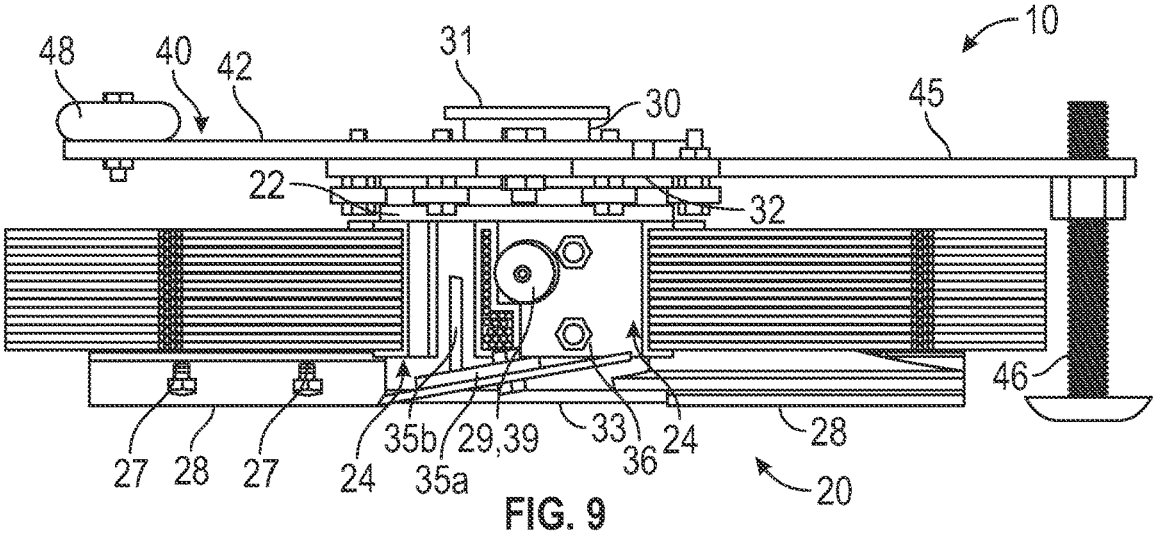
FIG. 9 is a side view of the same embodiment.
Figure 10:
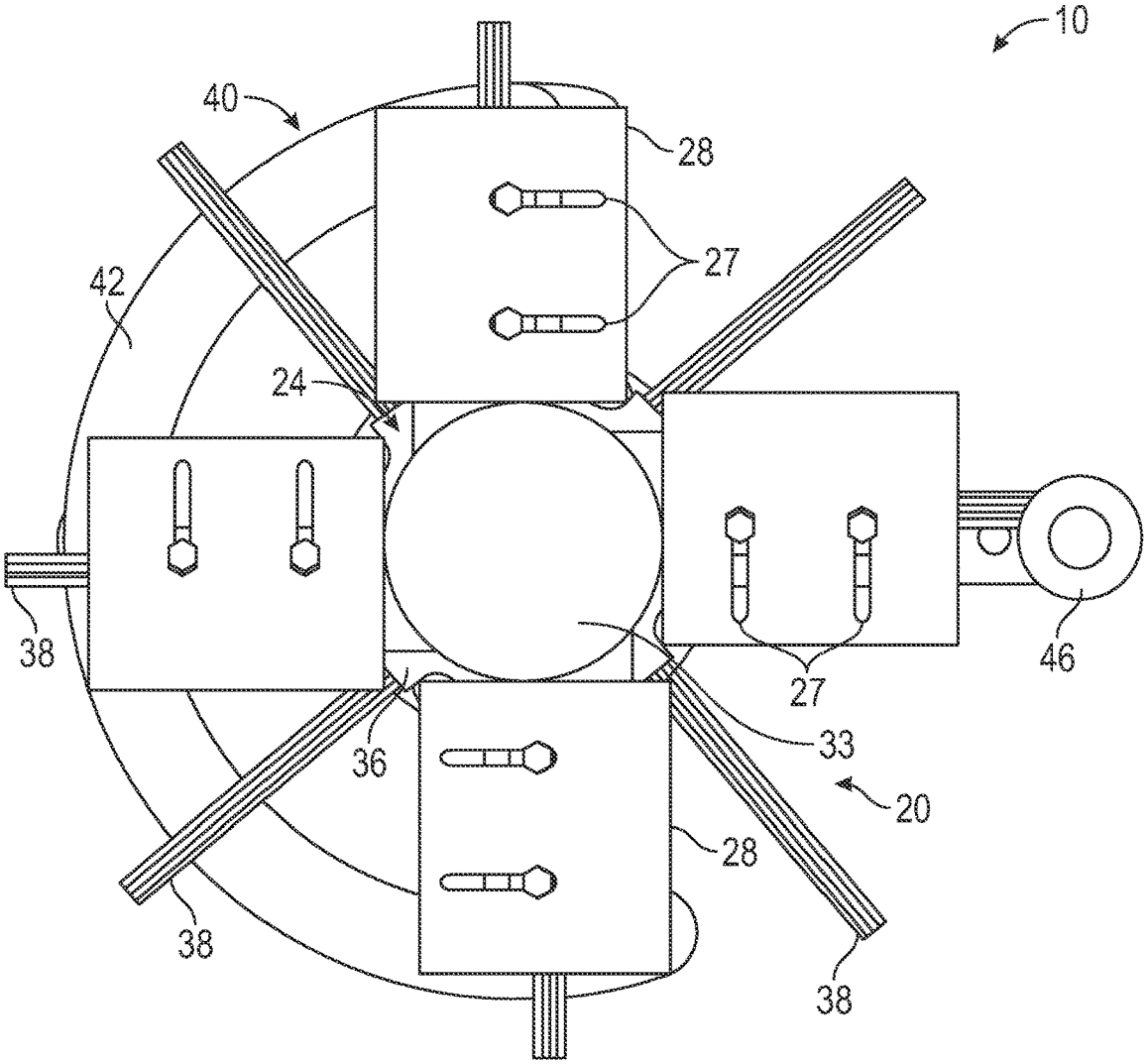
FIG. 10 is an underside view of the same embodiment.

Additionally, the operational engagement of flange 32 to components of support member 44 is more visible as FIG. 6 shows how the fastening members in the present example embodiment are affixed to support member 44 while their heads are used to interlock flange 32 of hub member 22. Due to the operational engagement of support member 44 to hub member 22, via flange 32, all rotational energy transmitted through gimbaled drive shaft 30 into hub member 22 will not be experienced by brush guard assembly 40 as flange 32 will rotate without transmitting that rotational energy to the affixed fasteners of support member 44 or to any other component of the assembly. The only component of brush guard assembly 40 that will rotate freely is wheel member 48 as it guides ice edger brush apparatus 10 along the ice rink walls, guarding them and the apparatus itself from damage, while leading portion 42 may be loosened prior to operation to allow for its own rotation as well.

Referring to the example embodiment shown in FIGS. 6 through 10, as can also be seen in FIGS. 1 through 5, in addition to the aforementioned gimbaled drive shaft 30 and brush guard assembly 40 being operationally coupled with hub member 22, hub member 22 is additionally shown as being operationally engaged with several other components of ice edger brush apparatus 10. Within the present example embodiment mounting members 36 are depicted as being operationally engaged to hub member 22 via peg protrusions 37, the grease (or other lubricant) necessary to insure adequate operability of ice edger brush apparatus 10 is only capable of reaching the necessary components of the present invention via hub grease port aperture 29 and brush grease port aperture 39 when properly aligned, and strut members 34 are illustrated as being affixed to hub member 22 wherein relatively horizontal portion 35*a* and relatively vertical portion 35*b* occupy the spaces of hub member 22 not touching any mounting member 36.

Likewise, as shown in FIGS. 6 through 10 as well as FIGS. 1 through 5, within this example embodiment's brush blade assembly 20, blade plate members 28 having elongated apertures 27 are detachably affixed to relatively horizontal portions 35*a*, via fastener members position through the apertures thereof, wherein loosening of said fastening members will allow an operator of ice edger brush apparatus 10 to alter the location, position, and attack angle of blade plate members 28. Similarly, within this example embodiment's brush guard assembly 40, skid prevention member 46 is depicted as detachably affixed to offshoot member 45 of support member 44 wherein fastening members are used to secure skid prevention member 46 at a specifically chosen height (typically based on the set attack angle of blade plate members 28), which is alterable by an operator via the loosening and retightening of said fastening members. The same may be said of the connection points between the aperture of offshoot members 45 of support member 44 operationally engaged via fastening members to elongate aperture 27 and an ordinary aperture of leading portion 42, wherein loosening of said elongate aperture's 27 fastening member will allow an operator to adjust the position of semi-lunate leading portion 42 relative to brush guard assembly 40, as well as ice edger brush apparatus 10 as a whole.

As has been mentioned above, and throughout the application, there are numerable additional embodiments contemplated and relating to various alternative sizes, shapes, orientations, locations, and other customizations, such as the inclusion of automation and more full operational control, that have been set forth explicitly as well as others that may be considered as contemplated embodiments which are logically drawn from, and understood to be within, the disclosures made herein. Any description, depiction, illustration, or explanation of the figures and example embodiments contained within this application shall not be construed as limiting or otherwise restricting the consideration of further embodiments and designs logically within the subject matter contained herein.

What is claimed is:

1. An ice edger brush apparatus operationally connectable to an ice resurfacing machine and usable for edging prior to resurfacing the whole of an ice surface, including the perimeter of an ice rink abutting the boards, said ice edger brush apparatus comprising:

a brush blade assembly comprising:

a rotatable hub member having an exterior surface, a first end, and a second end;

a plurality of brush members radially disposed circumferentially about the hub member exterior surface;

a plurality of blade members radially disposed at, or proximal to, the hub member second end, each of said blade members oriented generally coplanar with the hub member second end, each of said blade members including:

a blade plate member couplable with the hub member, or a component affixed thereto, and angularly positionable thereat to orient a honed leading edge between at least a first position and a second position; and a brush guard assembly disposed proximal the hub member first end, said brush guard assembly comprising:

a leading portion disposed to guide against the ice rink wall and prevent contact of the plurality of blade members with the ice rink wall when the hub member is rotated;

a supporting member disposed to maintain structural support and translate force between the leading portion and a lever arm assembly while allowing for transmission of rotational energy directed from the lever arm assembly to brush blade assembly;

wherein the brush blade assembly is extendible and the hub member rotatable by a user piloting the ice resurfacing machine whereby ice at the edges of the ice rink abutting the wall can be edged and then cleanly resurfaced.

2. The ice edger brush apparatus of claim 1 wherein the brush guard assembly further comprises a support member connectable about the hub member first end, said support member comprising:

a first offshoot member connectable with the lever arm assembly;

a skid prevention member disposed endwise upon the first offshoot member, said skid prevention member adjustably positionable to extend a length in contact with an ice surface;

a first connection point along a second offshoot member connectable with one end of the leading portion; and a second connection point along a third offshoot member connectable with the other end of the leading portion;

wherein the brush blade assembly is extendible to the extended position by action of the lever arm assembly communicating at least with the first member.

3. The ice edger brush apparatus of claim 2 wherein the brush guard assembly leading portion includes an elongate aperture disposed at one end by which the leading portion is adjustably securable between a first position and a second position by engagement with a single connection point of the support member through the elongate aperture.

4. The ice edger brush assembly of claim 2 wherein the hub member further comprises:

a central bore;

a gimbled drive shaft disposed in operational communication with the hub member via the central bore, said gimbled drive shaft moveable between a minimum deflection and maximum deflection to angle the brush blade assembly between a minimum incline and a maximum incline;

a flange disposed at the first end;

a track disposed on an underside of the flange; and at least one peg protrusion disposed along the exterior wall;

wherein the brush guard assembly secures to the hub member first end by action of a plurality of rotatable bearing fasteners disposed to engage against the flange and seat into the track, whereby the hub member travels against the rotatable bearing fasteners beneath the brush guard assembly by means of the track.

5. The ice edger brush assembly of claim 2 wherein the hub member further comprises a plurality of strut members radially disposed at the second end, each of said plurality of strut members disposed to fasten with a corresponding one of the plurality of blade members by action of at least one fastener engaged along the length of at least one elongate aperture disposed through the respective blade plate member whereby an angle of attack of each of the plurality of blade members is adjustable by securement of the respective blade plate member to the respective strut member at a continuum of positions securable along the length of the at least one elongate aperture.

6. The ice edger brush assembly of claim 3 wherein the leading portion includes at least one wheel member oriented to rotatably engage against the ice rink wall when the brush blade assembly is positioned most proximal thereto.

7. The ice edger brush assembly of claim 1 wherein each of the plurality of brush members comprises:

a mounting member configured to secure to the hub member exterior surface; and wherein the brush member is operationally coupled to the hub member by means of at least one aperture present in the mounting member configured to secure to at least one peg protrusion disposed along the exterior wall of hub member.

8. The ice edger brush assembly of claim 7 wherein the mounting member includes at least one elongate brush body disposed upon the mounting member and protruding perpendicularly therefrom, said at least one elongate brush body comprising a plurality of bristles.

9. The ice edger brush assembly of claim 7 wherein the mounting member includes at least a pair of elongate brush bodies disposed spaced-apart endwise upon the mounting member.

10. An ice edger brush apparatus operationally connectable to an ice resurfacing machine and usable for edging and resurfacing the whole of an ice rink, specifically including the perimeter abutting a wall of the ice rink, said ice edger brush apparatus comprising:

a brush blade assembly comprising:

a rotatable hub member having:

an exterior surface;

a first end;

a second end;

a central bore;

a flange disposed at the first end;

a track disposed on an underside of the flange;

a gimbled drive shaft disposed in operational communication with the hub member via the central bore, said gimbled drive shaft moveable between a minimum deflection and a maximum deflection to angle the brush assembly between a minimum incline and a maximum incline;

a plurality of brush members radially disposed circumferentially about the hub member exterior surface, each of the plurality of brush members including:

a mounting member configured to secure to the hub member exterior surface;

at least one elongate brush body comprising a plurality of bristles projected perpendicularly from the mounting member;

a plurality of blade members radially disposed at or proximal to the hub member second end, each of said blade members oriented generally coplanar with the hub member second end, each of said blade members including:

a blade plate member angularly positionable to orient a honed leading edge between at least a first position and a second position;

a brush guard assembly disposed proximal the hub member first end, said brush guard assembly comprising:

a leading portion disposed to guide against the ice rink wall and prevent contact of the plurality of blade members with the ice rink wall when the hub member is rotated;

a support member comprising:

a first member connectable with an existing lever arm;

a skid prevention member disposed endwise upon the first member, said skid prevention member adjustably positionable to extend a length in contact with an ice surface;

a first connection point connectable with one end of the leading portion;

a second connection point connectable with the other end of the leading portion;

at least one wheel member disposed upon the leading portion and oriented to rotatably engage against the ice rink wall when the brush assembly is positioned most proximal thereto; and a plurality of rotatable bearing fasteners disposed to engage the support member with the flange of the hub member when seated into the track whereby the hub member travels against the rotatable bearing fasteners beneath the guard assembly by means of the track;

wherein the brush blade assembly is extendible and the hub member rotatable by a user piloting the ice resurfacing machine whereby ice at the edges of the ice rink abutting the wall may be resurfaced.

11. The ice edger brush assembly of claim 10 wherein the hub member further comprises a plurality of strut members radially disposed at the second end, each of said plurality of strut members disposed to fasten with a corresponding one of the plurality of blade members by action of at least one fastener engaged along the length of at least one elongate aperture disposed through the respective blade plate member whereby an angle of attack of each of the plurality of blade members is adjustable by securement of the respective blade plate member to the respective strut member at a continuum of positions securable along the length of the at least one elongate aperture.

12. The ice edger brush assembly of claim 10 wherein the guard assembly leading portion is lunate and includes an elongate aperture disposed at one end by which the leading portion is adjustably securable between a first position and a second position by engagement with the support member through the elongate aperture.

* * * * *